US007419355B2

(12) United States Patent
Burdgick

(10) Patent No.: US 7,419,355 B2
(45) Date of Patent: Sep. 2, 2008

(54) METHODS AND APPARATUS FOR NOZZLE CARRIER WITH TRAPPED SHIM ADJUSTMENT

(75) Inventor: Steven Sebastian Burdgick, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 214 days.

(21) Appl. No.: 11/355,208

(22) Filed: Feb. 15, 2006

(65) Prior Publication Data

US 2007/0189893 A1 Aug. 16, 2007

(51) Int. Cl.
*F01D 25/26* (2006.01)

(52) U.S. Cl. ..... 415/213.1; 415/209.2; 415/214.1

(58) Field of Classification Search ..... 415/209.2, 415/213.1, 214.1
See application file for complete search history.

(56) References Cited

U.S. PATENT DOCUMENTS 3,836,281 A 9/1974 Czuszak
3,937,589 A * 2/1976 Remberg ..... 415/101
4,219,201 A 8/1980 Straslicka
4,296,538 A 10/1981 Straslicka
5,024,579 A 6/1991 Groenendaal, Jr. et al.
5,249,920 A 10/1993 Shepard et al.
5,915,697 A 6/1999 Bagepalli et al.
6,502,823 B1 1/2003 Turnquist et al.
6,547,522 B2 4/2003 Turnquist et al.
6,572,115 B1 6/2003 Sarshar et al.
6,702,549 B2 3/2004 Tiemann

* cited by examiner

*Primary Examiner*—Edward Look
*Assistant Examiner*—Dwayne J White
(74) *Attorney, Agent, or Firm*—Armstrong Teasdale LLP

(57) ABSTRACT

Methods and apparatus for a machine casing component carrier configured to support a machine component such that the longitudinal axis of the machine component is adjustable with respect to a longitudinal axis of a rotatable member of the machine are provided. The carrier includes a support member configured to fixedly engage the machine component, an outwardly radially extending flange configured to engage a complementary receptacle formed in the turbine casing such that the weight of the carrier is supported at least partially by the receptacle, and a selectably adjustable shim member positionable within the receptacle configured to control an alignment of the longitudinal axis of the machine component with respect to the longitudinal axis of the rotatable member.

20 Claims, 5 Drawing Sheets

METHODS AND APPARATUS FOR NOZZLE CARRIER WITH TRAPPED SHIM ADJUSTMENT

BACKGROUND OF THE INVENTION

This invention generally relates to assembling rotatable machinery. More specifically, the invention is directed to alignment of components within a stationary casing.

At least some known steam turbine designs include static nozzle segments that direct a flow of steam into rotating buckets coupled to a rotatable member. The nozzle airfoil construction is typically called a diaphragm stage. When more than one nozzle is supported by an outer structure or ring the construction is generally referred to as a nozzle carrier for a "drum construction" flowpath. The nozzle carrier is supported vertically by several methods at a horizontal joint between an upper carrier half and a lower carrier half. Typically the vertical supports include support bars, pins or flanges welded to the turbine casing. The flanges may also be cast as part of the turbine casing if using a cast construction for the nozzle carrier. Alignment of turbine components during assembly may take several shifts or days to adjust, as both the carrier and the rotor must be removed to make the adjustment.

At least some known casings support the nozzle carrier using blocks under the carrier horizontal supports. The rotor and/or the nozzle carrier must be removed to make modification to the vertical position of the carrier. Typically the support blocks are bolted to the casing or carrier. The adjusting blocks have to be removed for machining (grinding) to achieve the proper casing vertical position relative to the turbine centerline. The blocks are then re-installed and the carrier and rotor replaced to check if proper alignment was achieved. The sequence is then repeated to verify the position and repeated if necessary. This process is both time consuming and costly.

BRIEF DESCRIPTION OF THE INVENTION

In one embodiment, a machine casing component carrier includes a support member configured to fixedly engage the machine component, an outwardly radially extending flange configured to engage a complementary receptacle formed in the turbine casing such that the weight of the carrier is supported at least partially by the receptacle, and a selectably adjustable shim member positionable within the receptacle configured to control an alignment of the longitudinal axis of the machine component with respect to the longitudinal axis of the rotatable member. The carrier is configured to support a machine component such that the longitudinal axis of the machine component is adjustable with respect to a longitudinal axis of a rotatable member of the machine.

In another embodiment, a method of assembling a rotatable machine includes coupling a plurality of nozzle airfoils to an arcuate carrier including a radially outwardly extending flange, supporting the carrier by the flange in the casing receptacle, and adjusting a vertical position of the carrier with respect to the casing longitudinal axis using a shim positioned between the flange and the receptacle.

In yet another embodiment, a turbine includes a casing including an upper half shell and a lower half shell configured to couple together along a mating joint, a component cater configured to support a turbine component such that the longitudinal axis of the turbine component is in substantial alignment with a longitudinal axis of a rotatable member of the turbine, the carrier including, a support member configured to fixedly engage the turbine component, an outwardly radially extending flange configured to engage a complementary receptacle formed in the turbine casing such that the weight of the carrier is supported at least partially by the receptacle, and a selectably adjustable shim member positionable within the receptacle configured to control an alignment of the longitudinal axis of the turbine component with respect to the longitudinal axis of the rotatable member.

DETAILED DESCRIPTION OF THE INVENTION

Figure 1:
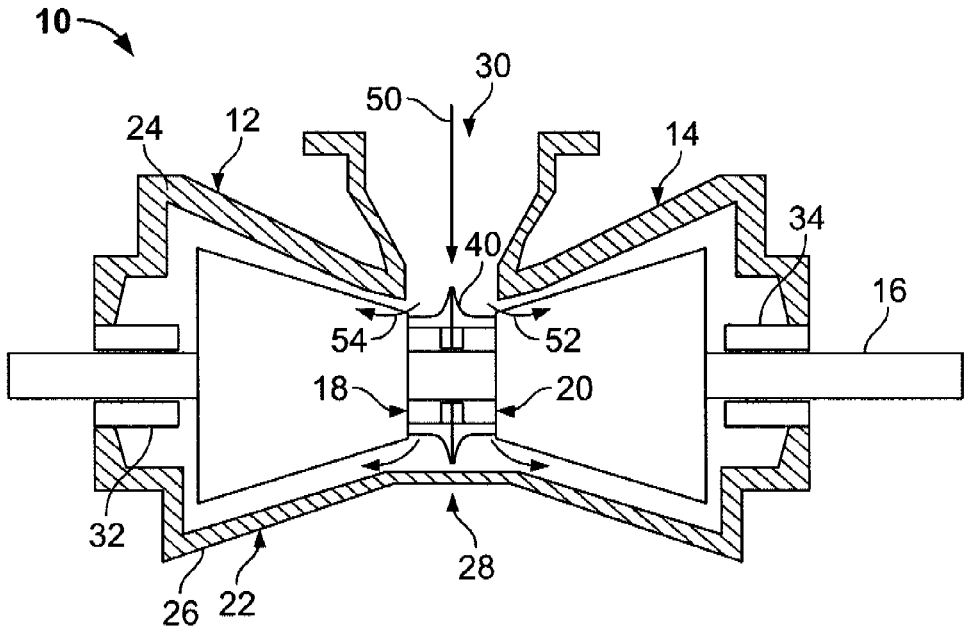
FIG. 1 is a schematic illustration of an exemplary opposed-flow steam turbine.

FIG. 1 is a schematic illustration of an exemplary opposed-flow steam turbine 10. Turbine 10 includes first and second low pressure (LP) sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

It should be noted that although FIG. 1 illustrates a double flow low pressure turbine, as will be appreciated by one of ordinary skill in the art, the present invention is not limited to being used with low pressure turbines and can be used with any double flow turbine including, but not limited to intermediate pressure (IP) turbines or high pressure (HP) turbines. In addition, the present invention is not limited to being used with double flow turbines, but rather may be used with single flow steam turbines as well, for example.

During operation, low pressure steam inlet 30 receives low pressure/intermediate temperature steam 50 from a source, for example, an HP turbine or IP turbine through a cross-over pipe (not shown). The steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The steam exits LP sections 12 and 14 and is routed to a condenser, for example.

Figure 2:
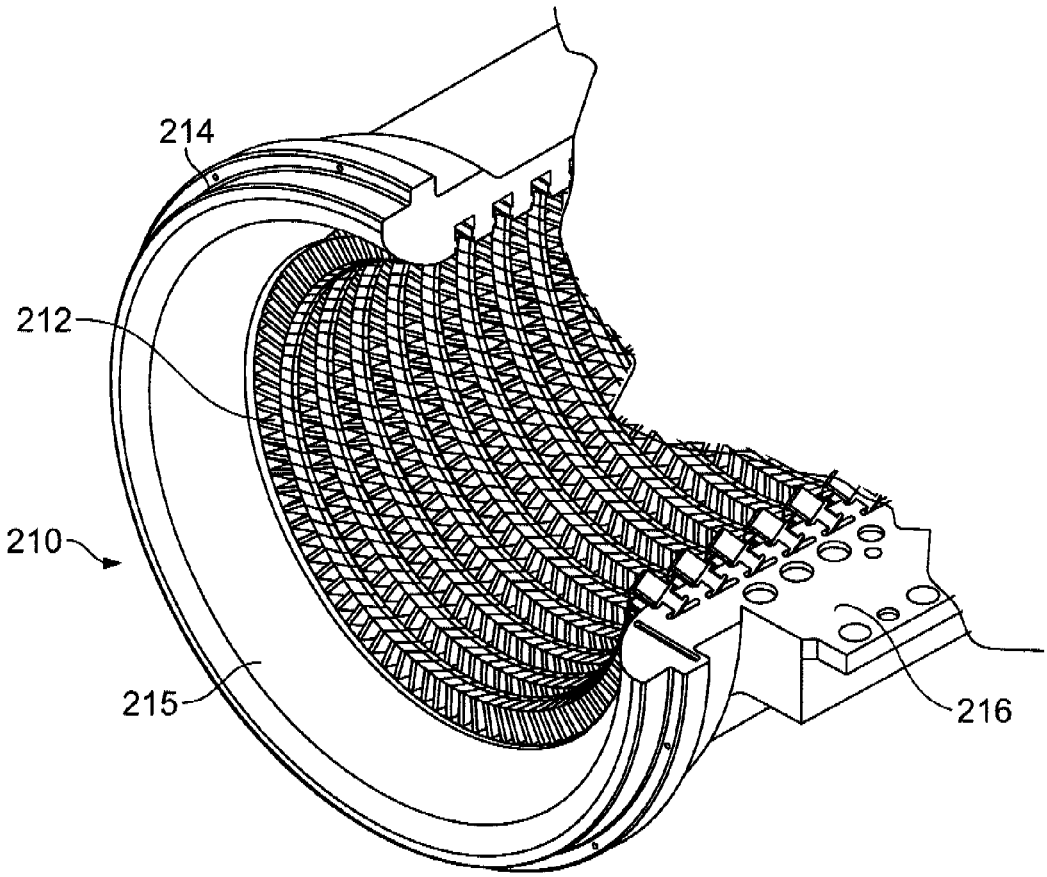
FIG. 2 is a perspective view of a nozzle carrier assembly configured to retain a plurality of nozzles of a turbine.

FIG. 2 is a perspective view of a nozzle carrier assembly 210 configured to retain a plurality of nozzles 212 of a turbine, for example, a steam turbine. Carrier 210 includes upper and lower carrier halves 214 and 215, respectively, which are joined one with the other along a horizontal joint face 216. Nozzles 212 are arranged in an annular array thereof at axially spaced locations along carrier 210. Each array of nozzles 212 includes a plurality of discrete nozzles 212 stacked one against the other. When a rotor (not shown) is positioned within lower carrier half 215 and carrier halves 214 and 215 are secured one to the other at the joint interface 216, nozzles 212, together with airfoils or buckets on the rotor, form multiple stages of a turbine.

Figure 3:
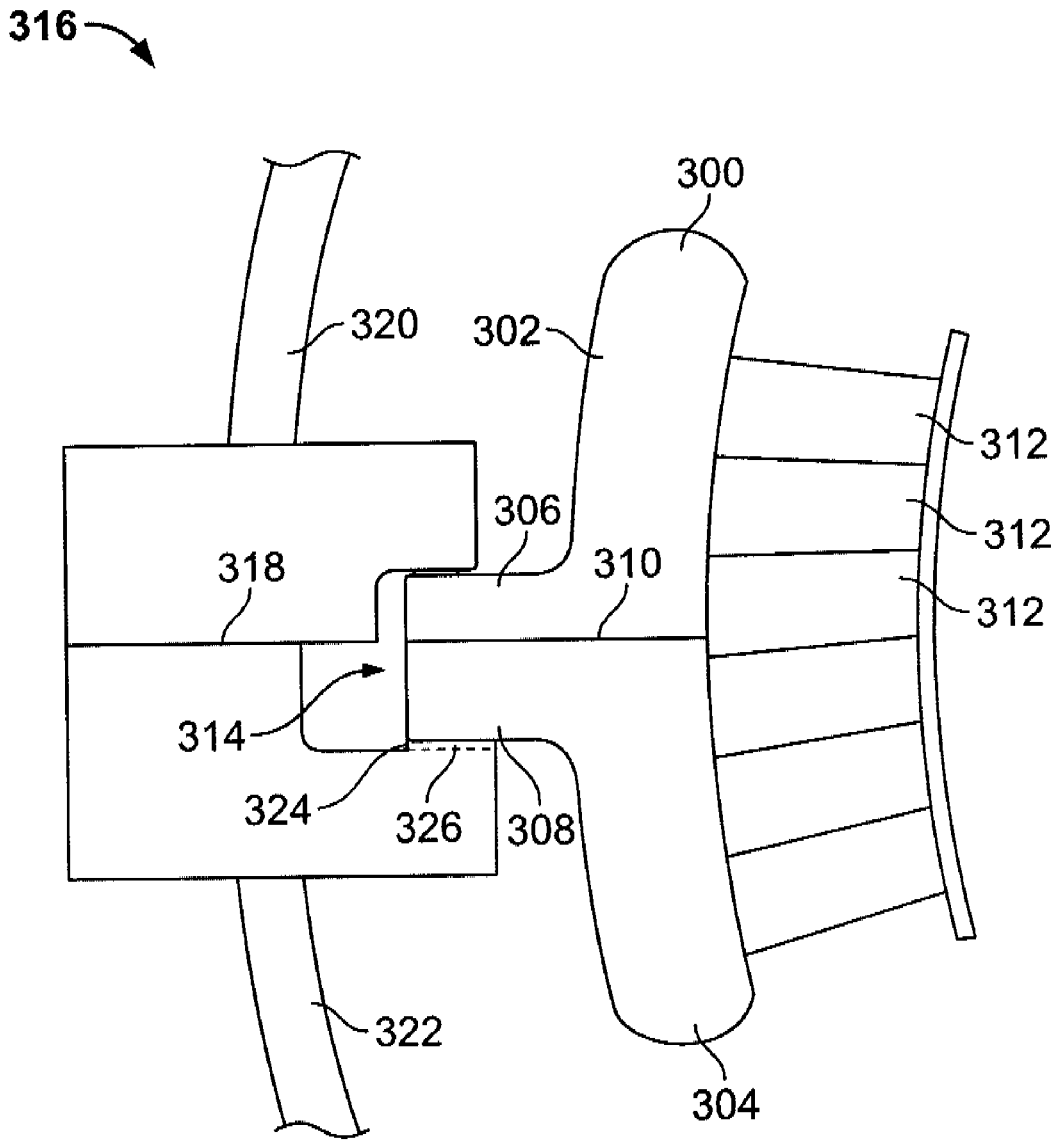
FIG. 3 is a schematic illustration of a portion of a nozzle carrier that may be used with the turbine shown in FIG. 1.

FIG. 3 is a schematic illustration of a portion of a nozzle carrier 300 that may be used with turbine 10 (shown in FIG. 1). Nozzle carrier 300 includes an upper half 302 and a lower half 304. Upper half 302 includes a first radially outwardly extending flange 306 and lower half 304 includes a second radially outwardly extending flange 308. Each flange 306 and 308 are configured to mate along a mating joint 310. In various embodiments, flange 306 is not used, for example, based on the weight of upper half 302. A plurality of nozzle airfoils 312 are configured to couple to nozzle carrier 300 in a circumferentially spaced arrangement. A pocket 314 is formed in the turbine casing or turbine shell structure 316 at a joint 318 between an upper shell 320 and a lower shell 322. Extending flanges 306 and 308 are configured to be received in pocket 314 such that lower half 304 is vertically supported by shell structure 316. In the exemplary embodiment, pocket 314 includes a recess 324 configured to receive a shim 326, which is "trapped" in a fixed position in recess 324. Accordingly, shim 326 is removable from recess 324 without removing nozzle carrier 300 or the turbine rotor from shell structure 316. Rather, carrier 300 is only lifted slightly at the associated side to allow the "trapped" shim to release from pocket 314. In an alternative embodiment, shim 326 is fabricated as a "shim pack" in which small thicknesses of shim layers are removable to adjust the thickness of shim 326 such that machining of shim 326 is reduced or eliminated. A second shim is positioned opposite shim 326 between upper shell 320 and extending flange 306 to limit the lifting of casing 316 if the torque applied to carrier 300 is greater that the assembled weight of carrier 300 on the associated side.

Figure 4:
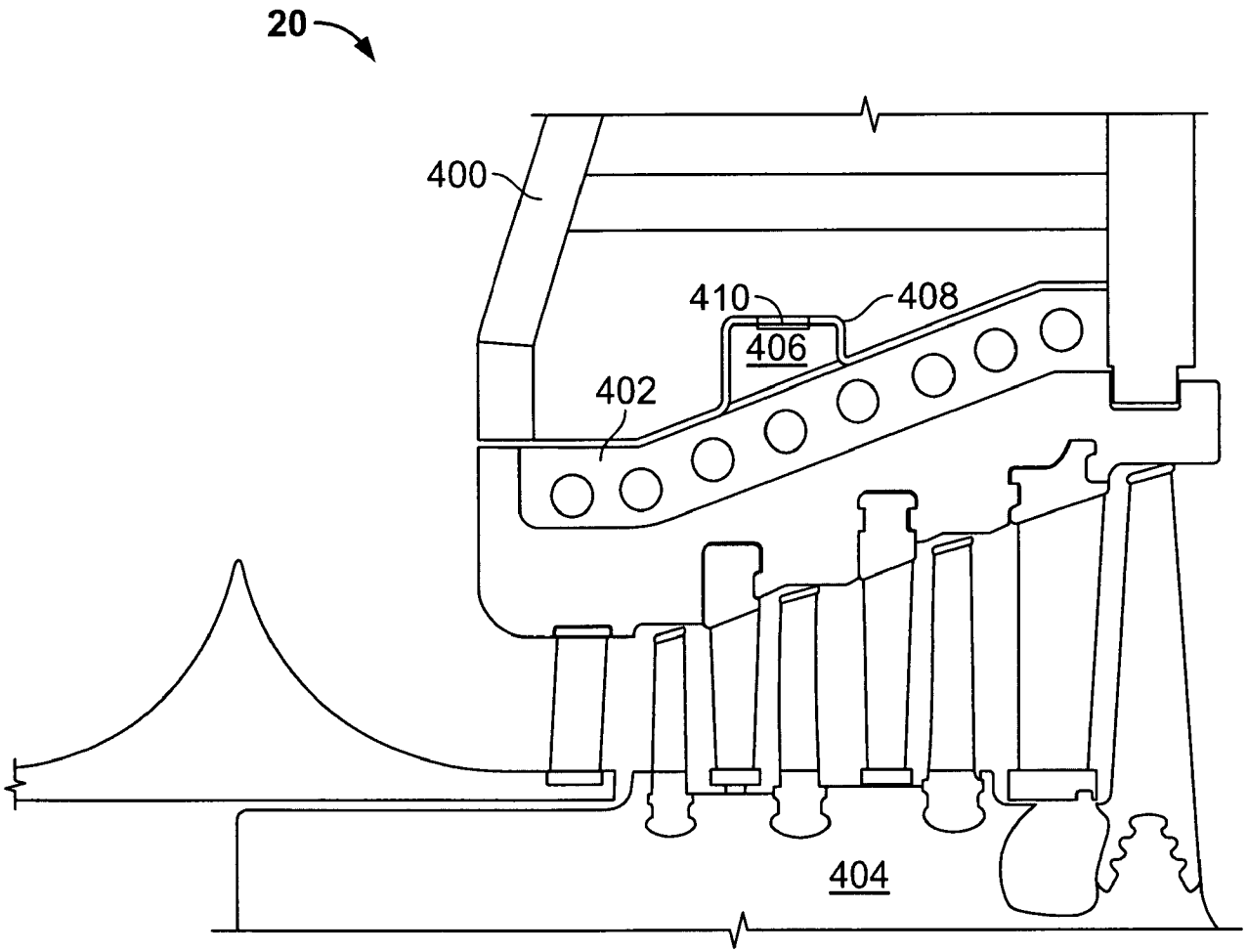
FIG. 4 is a schematic side view of a portion of the turbine engine shown in FIG.1.

FIG. 4 is a schematic side view of a portion of turbine engine 10 (shown in FIG. 1). Turbine engine 10 includes an upper half casing 400 that is bolted to a lower half casing (not shown) when turbine engine 10 is fully assembled. A nozzle carrier 402 mates to radially inner surfaces of casing 400. Such mating facilitates maintaining nozzle carrier 402 in a relatively fixed position with respect to a rotatable member 404, such as a turbine rotor. Nozzle carrier 402 includes a radial projection 406 that is configured to mate with a complementary groove 408 in casing 400. A shim 410 is insertable between projection 406 and groove 408 to limit the vertical movement of the casing. The aerodynamic forces on the nozzles causes a circumferential force on the carrier that could cause lifting off of the lower casing shelf on one side. In the exemplary embodiment, shim 410 is a round shim that is slightly recessed in projection 406. A similar configuration in the lower half casing and lower nozzle carrier segment may also be used.

Figure 5:
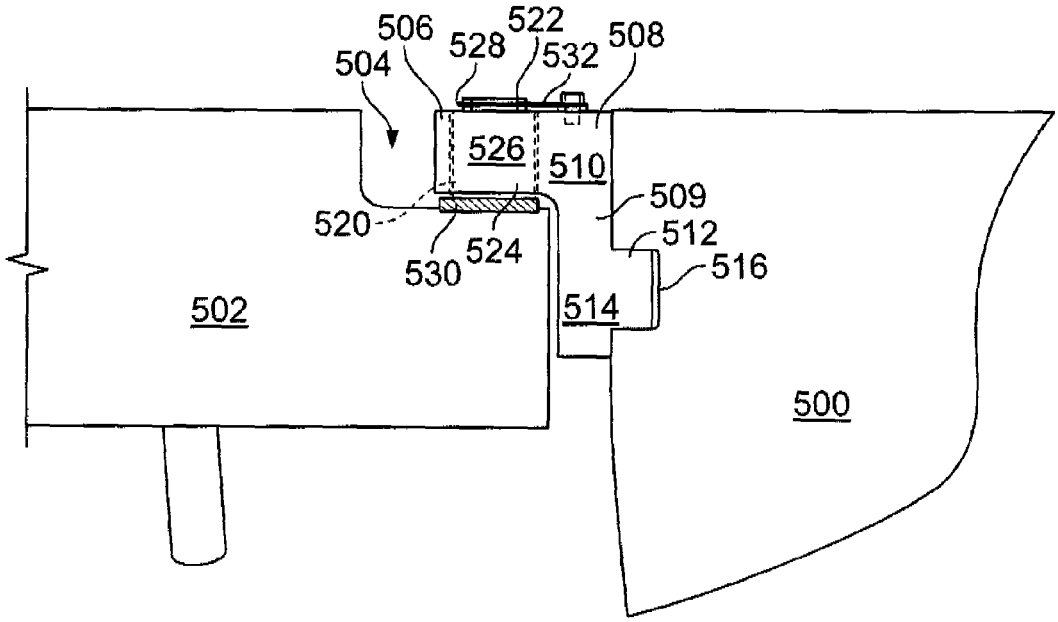
FIG. 5 is a schematic illustration of a portion of a nozzle carrier that may be used with the turbine shown in FIG. 1.
Figure 6:
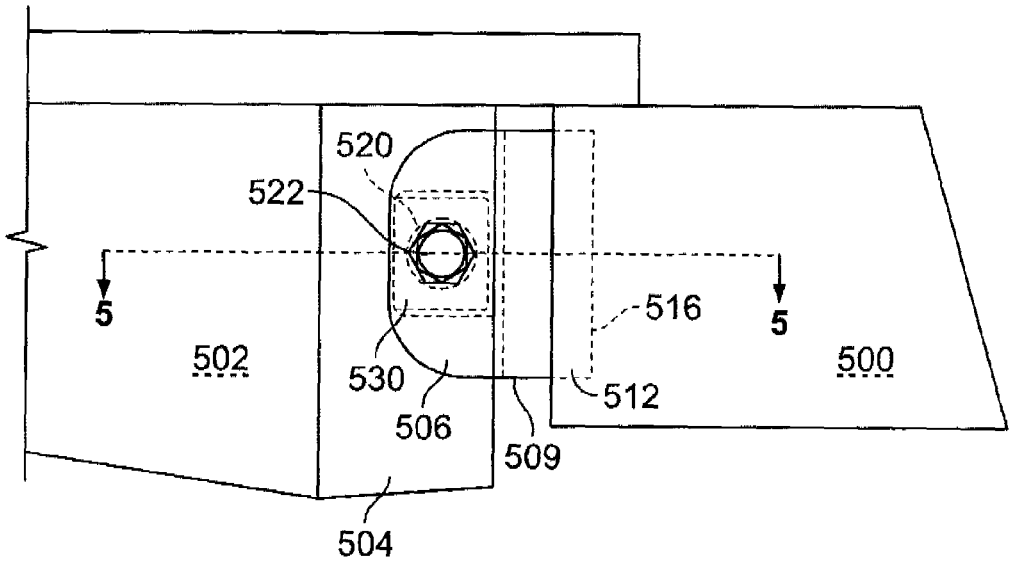
FIG. 6 is a plan view of the nozzle carrier taken along lines 5-5 shown in FIG. 6.
Figure 7:
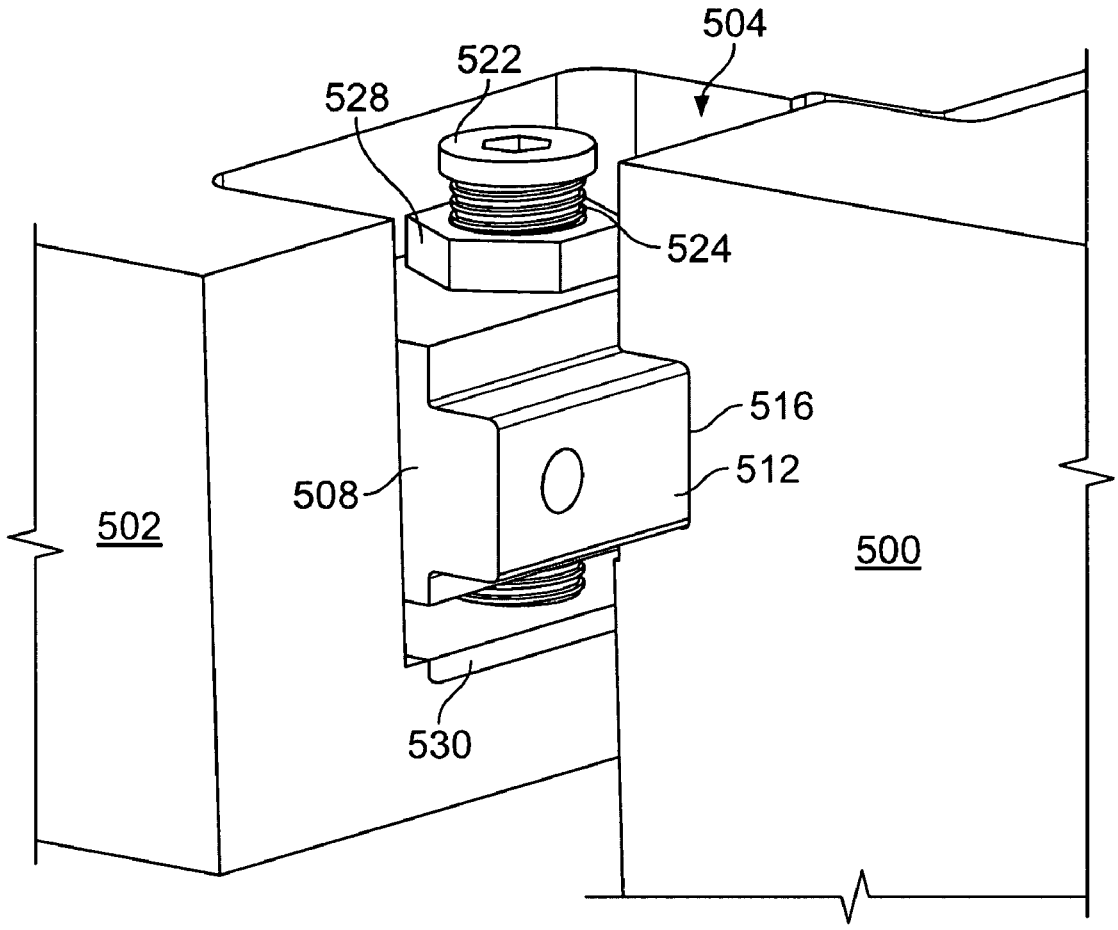
FIG. 7 is a perspective view of a portion of the nozzle carrier.

FIG. 5 is a schematic illustration of a portion of a nozzle carrier 500 that may be used with turbine 10 (shown in FIG. 1). FIG. 6 is a plan view of nozzle carrier 500 taken along lines 5-5 (shown in FIG. 6). FIG. 7 is a perspective view of a portion of nozzle carrier 500. In the exemplary embodiment, a turbine casing 502 includes a pocket 504 configured to receive an outwardly radially extending flange 506 of a carrier support member 508. Carrier support member 508 includes a vertically extending body 509 coupled to flange 506 at a first end 510 and radially inwardly extending flange 512 coupled to a second opposing end 514. Flange 512 is configured to engage nozzle carrier 500 such that a weight of nozzle carrier 500 is transferred through carrier support member 508 to casing 502. In the exemplary embodiment, inwardly extending flange 512 is received in a recess 516 formed in a radially outward periphery of nozzle carrier 500.

Outwardly radially extending flange 506 includes a vertically oriented hole 520 configured to receive a selectably adjustable shim member, such as an adjustment screw 522. In the exemplary embodiment, threads 524 on adjustment screw 522 engage complementary threads 526 cut into hole 520. In an alternative embodiment, threads 524 on adjustment screw 522 engage a locking nut 528. Adjustment screw 522 is further configured to transfer the weight of carrier 500 to a wear pad 530. Adjustment screw 522 is utilized to adjust a position of carrier 500 with respect to casing 502. Wear pad 530 is fabricated from a sacrificial material and protects casing 502 and adjustment screw 522 from mutual wear during an adjustment procedure. A locking plate 532 is used to lock adjustment screw 522 into a fixed position when the adjustment procedure is completed.

The above-described trapped shim carrier system is a cost-effective and highly reliable method for adjusting a vertical position of rotatable machine components without having to completely disassemble the machine.

While the invention has been described in terms of various specific embodiments, those skilled in the art will recognize that the invention can be practiced with modification within the spirit and scope of the claims.

What is claimed is:

1. A machine component carrier assembly configured to support a machine component such that the longitudinal axis of the machine component is adjustable with respect to a longitudinal axis of a rotatable member of the machine, said assembly comprising:

a support member configured to fixedly engage the machine component;

a receptacle formed in the machine component such that the weight of the carrier is supported at least partially by said receptacle;

a selectably adjustable shim member positionable within said receptacle; and an outwardly radially extending flange including a hole therethrough, said flange configured to engage said receptacle, said flange hole sized to receive at least a portion of said shim member therethrough;

said shim member configured to control an alignment of the longitudinal axis of the machine component with respect to the longitudinal axis of the rotatable member.

2. An assembly in accordance with claim 1 further comprising a radially outwardly extending projection configured to engage a complementary casing groove, and a shim positionable between said projection and said groove such that a vertical movement of said component carrier is substantially prevented.

3. An assembly in accordance with claim 2 wherein a thickness of said shim is selectable.

4. An assembly in accordance with claim 1 wherein said selectably adjustable shim member comprises an adjustment screw coupled to said machine component through said support member, said adjustment screw configured to control an alignment of the machine component with respect to the casing.

5. An assembly in accordance with claim 1 wherein said support member is configured to fixedly engage the machine component along an inner periphery of the support member.

6. An assembly in accordance with claim 1 wherein said shim member comprises a plurality of shims.

7. An assembly in accordance with claim 1 wherein said turbine casing comprises an upper half and a lower half and wherein said shim member comprises a first shim positioned between the flange and the lower half and a second shim positioned between the flange and the upper half.

8. An assembly in accordance with claim 1 wherein said support member comprises a plurality of arcuate segments, each segment comprising an outwardly radially extending flange configured to couple to at least one of an adjacent segment and a casing receptacle.

9. A method of assembling a rotatable machine that includes a radially outer casing having a longitudinal axis and an inwardly oriented support receptacle, said method comprising:

coupling a plurality of nozzle airfoils to an arcuate carrier including a radially outwardly extending flange;

supporting the carrier by the flange in the casing receptacle, wherein the flange includes a hole therethrough, the flange hole sized to receive at least a portion of a selectably adjustable shim member therethrough; and adjusting a vertical position of the carrier with respect to the casing longitudinal axis using the selectably adjustable shim member positioned between the flange and the receptacle.

10. A method in accordance with claim 9 wherein adjusting a vertical position of the carrier with respect to the casing longitudinal axis comprises adjusting a vertical position of the carrier with respect to the casing longitudinal axis without removing the carrier from the machine.

11. A method in accordance with claim 9 wherein adjusting a vertical position of the carrier with respect to the casing longitudinal axis using a selectably adjustable shim member positioned between the flange and the receptacle comprises positioning a shim within a recess in a surface of the receptacle.

12. A method in accordance with claim 9 wherein adjusting a vertical position of the carrier comprises adjusting the vertical position of the carrier using an adjustable screw extending between said carrier and said casing.

13. A method in accordance with claim 9 wherein said casing includes a circumferential groove radially outward from a complementary radial projection at least partially circumscribing the carrier, said method further comprising positioning a shim between the groove and the projection such that a radially outward movement of the carrier is substantially prevented.

14. A turbine comprising:

a casing comprising an upper half shell and a lower half shell configured to couple together along a mating joint;

a component carrier configured to support a turbine component such that the longitudinal axis of the turbine component is in substantial alignment with a longitudinal axis of a rotatable member of the turbine, said carrier comprising:

a support member configured to fixedly engage the turbine component;

a receptacle formed in the machine component such that the weight of the carrier is supported at least partially by said receptacle;

a selectably adjustable shim member positionable within said receptacle; and an outwardly radially extending flange including a hole therethrough, said flange configured to engage said receptacle, said flange hole sized to receive at least a portion of said shim member therethrough;

said shim member configured to control an alignment of the longitudinal axis of the turbine component with respect to the longitudinal axis of the rotatable member.

15. A turbine in accordance with claim 14 further comprising a radially outwardly extending projection configured to engage a complementary casing groove, and a shim positionable between said projection and said groove such that a vertical movement of said component carrier is substantially prevented.

16. A turbine in accordance with claim 15 wherein said selectably adjustable shim member comprises an adjustment screw coupled to said machine component through said support member, said adjustment screw configured to control an alignment of the machine component with respect to the casing.

17. A turbine in accordance with claim 14 wherein said support member is configured to fixedly engage the turbine component along an inner periphery of the support member.

18. A turbine in accordance with claim 14 wherein said shim member comprises a plurality of shims.

19. A turbine in accordance with claim 14 wherein said turbine casing comprises an upper half and a lower half and wherein said shim member comprises a first shim positioned between the flange and the lower half and a second shim positioned between the flange and the upper half.

20. A turbine in accordance with claim 14 wherein said support member comprises a plurality of arcuate segments, each segment comprising an outwardly radially extending flange configured to couple to at least one of an adjacent segment and a casing receptacle.

* * * * *